United States Patent [19]

Kunin et al.

[11] 4,187,120

[45] Feb. 5, 1980

[54] METHOD FOR PURIFICATION OF POLYHYDRIC ALCOHOLS

[75] Inventors: Robert Kunin, Yardley, Pa.; Louis I. Blaine, Orange, N.J.

[73] Assignee: Ecodyne Corporation, Chicago, Ill.

[21] Appl. No.: 910,628

[22] Filed: May 30, 1978

[51] Int. Cl.[2] ..... C13D 3/14

[52] U.S. Cl. ..... 127/46 A; 127/55; 210/30 R; 210/193

[58] Field of Search ..... 127/46 A, 55; 210/30 R, 210/193

[56] References Cited

U.S. PATENT DOCUMENTS

| | | | |
|---|---|---|---|
| 2,366,007 | 12/1944 | D'Alelio | 210/24 |
| 2,488,851 | 11/1949 | Copp | 210/55 |
| 2,490,716 | 12/1949 | Smith | 127/46 A X |
| 2,591,573 | 4/1952 | McBurney | 260/88.1 |
| 2,658,042 | 11/1953 | Johnson | 260/2.2 |
| 2,681,319 | 6/1954 | Bodamer | 127/46 A X |
| 2,728,694 | 12/1955 | Swanson | 127/13 |
| 2,892,737 | 6/1959 | Rohwer | 127/40 |
| 3,044,904 | 7/1962 | Serbid | 127/46 |
| 3,073,725 | 1/1963 | Popper | 127/46 |
| 3,074,820 | 1/1963 | Kunin | 127/46 A |
| 3,213,016 | 10/1965 | Gowers | 127/46 A X |
| 3,250,702 | 5/1966 | Levendusky | 127/46 A |
| 3,250,703 | 5/1966 | Levendusky | 127/46 A X |
| 3,250,704 | 5/1966 | Levendusky | 210/24 |
| 3,420,709 | 1/1969 | Barrett | 127/53 |
| 3,436,260 | 4/1969 | Duff | 127/55 |
| 3,508,965 | 4/1970 | Harrison | 127/55 X |
| 3,563,799 | 2/1971 | Zievers | 127/46 |
| 3,730,770 | 5/1973 | Zievers | 127/46 B |
| 3,753,899 | 8/1973 | Kunin | 210/33 |
| 3,779,386 | 12/1973 | Ryan | 210/193 |
| 3,791,866 | 2/1974 | Kunin | 210/30 R X |
| 3,966,489 | 6/1976 | Barrett | 127/46 A |

OTHER PUBLICATIONS

Robert Kunin, "Ion Exchange Resins", 181–188, Robert E. Krieger Publishing Co., Huntington, N.Y., 1972.

"Duolite Ion Exchange Resins In the Treatment of Sugar Solutions", published by Diamond Shamrock Chemical Co., 1972.

Robert Kunin, "Elements of Ion Exchange", 125–126, Robert E. Krieger Publishing Co., Huntington, N.Y., 1971.

*Primary Examiner*—Sidney Marantz

*Attorney, Agent, or Firm*—David A. Anderson; Gary M. Ropski

[57] ABSTRACT

A method for purification of polyhydric alcohols such as sugar syrup by removing chromophoric components, trace metals, and other impurities comprising preparing a liquid slurry mixture of filter particles, including an anion exchange resin, a cation exchange resin, and a filter aid material, the anion and cation exchange resins being smaller than about 100 mesh (about 150 microns); precoating a porous support means with the slurry mixture; and passing the polyhydric alcohol through the precoat layer and the porous support means to purify the alcohol. A further embodiment includes the step of regenerating the precoat layer by delivering a brine solution having a pH between 7 and 10 through the precoat layer.

12 Claims, No Drawings

METHOD FOR PURIFICATION OF POLYHYDRIC ALCOHOLS

The present invention relates generally to purification of polyhydric alcohols, and in particular to a method for removal of chromophoric components, trace metals, and other impurities from sugar syrup using a flocculated precoat of filter particles, including ion exchange resins smaller than 100 mesh, and a filter aid material.

Sugar beets and sugar cane are the major sources of sucrose from which white table sugar is derived. After extraction of the sugar from these sources, removal of gross impurities is accomplished in processes referred to as defecation and affination. Subsequent steps of evaporation to concentrate the extract and boiling to crystallize the sucrose yield a raw product which must be purified to obtain a marketable product.

Purification of polyhydric alcohols such as sugar syrups in a refining process removes color bodies and certain trace metals such as iron, copper, zinc, and nickel present in the raw sugar product. The decolorization and removal of trace metals is particularly necessary when the marketed product is white sugar, as color in such a product reduces consumer acceptance.

The chromophoric or color bodies in the raw sugar product typically exist as highly-colored anions, usually in the form of salts of weak acids. However, chromophoric components may be either highly ionic, weakly ionic, or non-ionic species. The trace metals exist as cations, or may be complexed with organic acids or color bodies as anionic complexes. In addition to trace metals, certain cationic impurities such as calcium and magnesium may be present.

Weakly ionic and non-ionic species of chromophoric components are typically adsorbed by filter particles having a high moisture content indicating high porosity. Highly ionic chromophoric components are removed by an anion exchange reaction, typically with a strong-base anion exchange resin. During adsorption, an initially rapid surface adsorption occurs wherein the quantity of color adsorbed is a function of total resin area. It is theorized that subsequent adsorption is accomplished by diffusion of color bodies into the resin, with additional removal capacity related to total resin weight.

The moisture content of a filter particle, such as an ion exchange resin, is expressed as a percentage of water in relation to the total weight of the particle. To determine moisture content of ion exchange resins, for instance, the resin is first prepared by drying surface moisture from the bead resin, which is wet and swollen as supplied. The resin is then weighed and dried further at 105° C. in an oven to drive off all free moisture. The measured difference in weight before and after oven drying is the percent of moisture content of the bead resin, an indication of the porosity or moisture adsorbing capacity of the resin. The moisture content of the resin as measured in bead form also accurately indicates the moisture content of the resin after it is ground to a finely divided state, i.e., a size of less than 60 mesh (250 microns).

As used herein, the term "bed" refers to a layer of filtration material, such as a precoat layer, which has been deposited on a filter support such as a filter screen, an annular filter cartridge, a film, a deep or shallow bed, or the like. In general, a shallow bed is to be preferred over a deep bed because of the desire to minimize the pressure drop, thereby generally increasing the run length that is available.

It is also to be understood in connection with the present application that when ratios or percentages of resins or filter aid materials are discussed, applicants always refer to the dry weight of the material involved.

In the prior art, methods are known for purification of sugar syrup by adsorption, such as disclosed in U.S. Pat. No. 3,420,709 issued to Barrett. According to that patent, color impurities or precursors of color-bearing materials are removed from a sugar solution by passing the sugar solution through two or more adsorbents of fine or "micronized" particle size. However, the process set forth in that patent is a batch process, mixing micronized adsorbent with the sugar syrup, in order to allow an increased flow rate over methods using deep beds of resin, while maintaining adequate contact time. However, the flow rates of this prior art method have proven to be uneconomical even with agitation of the adsorbent.

Another prior art method, disclosed in U.S. Pat. No. 3,250,703, issued to Levendusky, and assigned to the assignee of the present invention, includes precoating a filter screen with finely divided mixed anion and cation exchange resins in the size range of 60 to 400 mesh and passing a liquid through the filter precoat to remove impurities therefrom. It is suggested in this patent that color bodies and ash can be removed from sugar solutions with the disclosed method. However, disadvantages such as a tendency for the precoat layers to crack are sometimes present in the prior art method. Once a filter precoat cracks, the pressure drop across the filter decreases significantly, and a complete breakdown of the filtration ability of the filter precoat may result. Also, mixed ion exchange resins sometimes "bleed through" a porous support means, particularly when the resin particles are precoated onto stainless steel filter elements, and the resin particles themselves pass through the element and contaminate the liquid stream. Finally, a bed made entirely of ion exchange resins often is not required for purification of sugar syrups, when the primary chromophoric components are non-ionic or only weakly ionic.

Methods of the prior art also generally have the disadvantage of producing sugar syrups that crystallize at room temperature upon standing. The high fructose corn syrup which is the end product of the acid/enzyme hydrolysis method following purification using powdered carbon in an almost colorless syrup of about 70 Brix composition. As used herein, the term "Brix" refers to a measure of the concentration in percent of sugar by weight according to the Brix hydrometer scale, which is familiar to those skilled in the art. The 70 Brix fructose solution is not stable at room temperature and slowly forms fructose crystals on standing, as indicated by high turbidity followed by partial solidification. The crystals can be redissolved by heating to 100° F., at which temperature the solution becomes a clear liquid again. However, upon cooling to room temperature and standing for several days, the same crystallization process occurs. Because of these crystallization tendencies of fructose syrup and other typical sugar syrups, these syrups are difficult to transport, as methods used for transporting liquids may be ineffective when the sugar syrup crystallizes.

Other disadvantages of prior art apparatus and methods to purify sugar syrups are that regeneration of the ion exchange resins utilized is typically difficult and expensive. When ion exchange resins are precoated on a filter support means, the resins must typically be backwashed and discarded when they become exhausted. Also, the typical prior art deep-bed filters of ion exchange resins require significantly long contact times and high flow rates thereby restricting the apparatus and process for sugar syrup purification to installations which can economically accommodate such long run times. The large quantity of bead-type resin for deep-bed filters per unit volume of sugar syrup is also economically unattractive in the prior art apparatus and method because of the expense of resin.

According to the present invention there is provided a method for purification of polyhydric alcohols such as sugar syrup, which overcomes many of the disadvantages of the prior art. For instance, cane sugar, corn sugar and beet sugar syrups may be purified according to the present invention, as well as polyhydric alcohols such as sucrose, dextrose, fructose, glycerin, or sorbates.

The method of purification of sugar syrup according to the present invention includes preparing a liquid slurry mixture of filter particles including an anion exchange resin, a cation exchange resin and a filter aid material, the anion and cation exchange resins being smaller than about 100 mesh (about 150 microns); precoating a porous support means with the slurry mixture; and passing sugar syrup through the precoat layer and the porous support means to purify the syrup by removing chromophoric compounds, trace metals, and other impurities. The anion exchange resin preferably has a moisture content of between 45 and 80 percent, and the porous support means is precoated to a level of 0.1 to 1.0 pounds per square foot of filter area. The sugar syrup is preferably passed through the precoat layer and the precoat support means at a temperature between 120° F. and 180° F., and a flow rate of 0.1 to 2 gallons per minute per square foot.

Although the ion exchange precoat resins are typically relatively inexpensive so that they may be economically discarded after exhaustion, the precoat layer according to the present invention may be regenerated in situ, that is, without removing the precoat layer from the support means by a backwash step. The precoat layer is regenerated by delivering a brine solution, having a pH adjusted to between 7 and 10 with sodium hydroxide or ammonium hydroxide, through the precoat layer in the service cycle direction.

The use of a slurry mixture of ion exchange resin and filter aid material precoated on a porous support means allow a relatively high flow rate for delivery of sugar syrup to the precoated filter in comparison with the flow rate for comparable deep-bed filters. Because of the large adsorption and ion exchange are presented by particles smaller than 100 mesh, purification of sugar syrup requires less contact time with the filter media. Large gains in capacity for ion exchange and adsorption are possible as the total surface area of the finely divided ion exchange resin particles is increased in comparison with bead resin particles and certain "finely divided" particles of the prior art.

Additional advantages are a low capital installation cost for an apparatus using the method of the present invention, a small space requirement, and reduced pumping costs compared to deep-bed filters. Pumping costs are reduced because the method of the present invention requires a pressure drop of less than about 50 p.s.i.g. for a high-Brix syrup. Another advantage is reduced generation of sweetwater. Sweetwater is typically generated when water is used to remove sugar product left in the bed toward the end of the service cycle. The sweetwater can sometimes be recycled if the concentration of sugar is large enough, but typically the sweetwater is discarded and results in a loss of sugar product. The relatively small depth of the filter precoat employed in the present invention and the longer effective run reduce the amount of sugar product that must be removed with water, thereby reducing the waste of sugar product accompanying the generation of sweetwater.

Some of the advantages of the present invention are due to the favorable small particle ion exchange kinetics. Ion exchange kinetics are governed by factors such as film diffusion and particle diffusion. Film diffusion is the process by which ions from the liquid phase pass across the stationary film of liquid attached to the outer surface of the ion exchange resin, and particle diffusion is the process by which ions travel through the ion exchange matrix to active ion exchange sites.

The use of ion exchange resins for the purification of sugar syrups in the prior art has shown that the reaction kinetics for such purifications, particularly of sugar syrups having a high Brix rating, are much slower than typical purification behavior for water. When strong acid and strong base resins are used for sugar syrup purification, film diffusion is much slower, thereby resulting in lower operating flow rates when maximum utilization of the ion exchanger is attempted. In addition, when used for decolorization, particle diffusion is relatively slow due to the large size of the organic chromophoric components which travel through the ion exchange resin matrix only with great difficulty. Both of these processes of film and particle diffusion depend on particle size, and it has been shown that the ion exchange kinetics improve rapidly as a function of decreasing particle size, thus accounting for the superiority of the kinetics of finely divided ion exchange resin systems and processes over those of comparable bead ion exchange systems. In short, the use of ion exchange resins smaller than 100 mesh according to the present invention allows purification of sugar syrup to be accomplished in a precoat layer approximately ¼ inch thick, which purification is comparable or superior to that achieved by a typical three to ten-foot depth of ion exchange bead resin.

Also, it is predicted that sugar syrup treated according to the method of the present invention does not crystallize readily upon standing. The manner in which the present invention achieves this stability is not fully understood. However, it has been theorized that the method of the present invention so thoroughly purifies the sugar syrup that no sites are left for crystallization or nucleation to commence.

Furthermore, significant run lengths are obtained according to the present invention without interruptions resulting from high pressure drops or cracks in the precoat. This result is accomplished particularly through the use of a filter aid material which is flocculated in conjunction with cation and anion exchange resins. It might be expected that a ⅛ inch thick layer of resin particles smaller than 200 to 300 mesh would present a very high pressure drop, even higher than powdered carbon, thereby rendering the use of small resin particles highly uneconomical. However, it has been found that flocculated mixtures of resins, particularly with the addition of filter aid material, form porous agglomerates which present a relatively low pressure drop in a filter precoat layer, typically less than about 1 p.s.i.g. for water at 4 gallons per minute per square foot at 77° F.

According to the present invention, there is provided a method for purification of sugar syrups by removal of chromophoric components, trace metals, such as iron, copper, zinc, and nickel, and other impurities, such as calcium and magnesium. The first step of the method comprises preparing a liquid slurry mixture of filter particles, including an anion exchange resin, a cation exchange resin, and a filter aid material. The anion exchange resins and cation exchange resins are smaller than about 100 mesh (about 150 microns). As discussed in U.S. Pat. No. 3,250,702, issued to Levendusky, assigned to the assignee of the present invention, and incorporated herein by reference, anion and cation exchange resins in a finely divided size range of 60 to 400 mesh have a tendency to agglomerate or "clump," forming flocculated particles. The method of the present invention additionally flocculates ion exchange resins smaller than 400 mesh (about 37 microns) in the salt form. Also, the method of the present invention uses not only cation and anion exchange resins, but also filter aid material. All of these types of particles are flocculated by mixing them together in a liquid slurry.

The second step of the present invention includes precoating a porous support means with the flocculated mixture of filter particles. The porous support means may consist of a tubular or annular filter element, filter screen, or filter bed. In the preferred embodiment, the precoat support means is a filter element, such as shown and described in U.S. Pat. No. 3,779,386, issued to Ryan, assigned to the assignee of the present invention, and incorporated herein by reference. However, the filter elements may also consist of wound layers of yarn or other strand material, such as nylon, orlon, polypropylene, cotton, and the like. The precoating step is accomplished as set forth in the Ryan patent noted above to produce a layer of between 1/16 and 2 inches thick, more preferably $\frac{1}{8}$ to 1 inch thick, and most preferably between $\frac{1}{8}$ to $\frac{5}{8}$ inch thick.

The third step according to the method of the present invention is passing sugar syrup to be purified through the porous support means and the precoat layer on the porous support means to purify the sugar syrup. Additionally, there is included a further step of regenerating the anion exchange resins with a suitable brine solution without backwashing or otherwise rearranging the precoat layer. The brine is preferably supplied in situ in the service cycle direction at a concentration of between 5 and 15 percent. However, the inexpensive nature of the finely divided ion exchange resins permits them to be economically discarded without regeneration.

According to the preferred embodiment of the present invention, the dry weight ratio of anion exchange resin to cation exchange resin is between 1:1 and 99:1, and the dry weight ratio of total resin to filter aid material is between 1:4 and 9:1. Most preferably, the anion exchange resin, cation exchange resin, and filter aid material are present in about equal amounts by dry weight.

During the precoating step, it is desirable to attain a precoat application of between 0.1 and 1.0 pounds per square foot of filter area. Also, the sugar syrup is preferably passed through the precoat layer and the precoat support means at a flow rate of between 0.1 to 2 gallons per minute per square foot, and a temperature range of 120° F. to 180° F.

The ion exchange resin particles used in the present invention are typically supplied in relatively large-bead form (greater than 60 mesh), and are ground to a size range smaller than about 100 mesh (about 150 microns) for use in the present invention. However, any suitable method may be used to obtain the desired particle size according to the present invention. A more preferred particulate size range is between about 1 to 75 microns and most preferably between about 10 and 30 microns.

Suitable cation and anion exchange resins which may be employed in accordance with the present invention are of the strong acid and strong base type. Such resins are described in the aforementioned Levendusky U.S. Pat. No. 3,250,702, and are well known in the art. Typical solid cation exchange resin particles include those of the divinylbenzene-styrene copolymer type, the acrylic type, the sulfonated coal type, and the phenolic type. Such resins may be used in the sodium, hydrogen, ammonium, or hydrazine form for example. It has been found that when cation exchange particles smaller than about 40 microns are used, a non-hydrogen form is preferred. The preferred cation exchange resins are the sulfonated styrene-divinylbenzene copolymers described in U.S. Pat. No. 2,366,007, and employed in the sodium form, particularly the resin sold under the trademark of Amberlite IR-120, a product of the Rohm and Haas Company.

Typical solid anion exchange resin particles that may be employed are the phenolformaldehyde type, the divinylbenzene-styrene copolymer type, the acrylic type, and the epoxy type. These resins may be used in the hydroxide or chloride form, for example. However, it has been found that when anion exchange particles smaller than about 40 microns are used, the chloride form is preferred. In particular, preferred anion exchange resins are of the quaternary ammonium type such as quaternized, aminolized cross-linked acrylate esters. One preferred type of anion resin is a reaction product of methylacrylate divinylbenzene aminolized with dimethylaminopropylamine and quaternized with methyl sulfate, sold under the trademark of Amberlite IRA-458, a product of the Rohm and Haas Company. Another preferred anion exchange resin is a chloromethylated styrene-divinylbenzene copolymer aminated with trimethylamine, as described in U.S. Pat. No. 2,591,573, employed in the chloride form and particularly the resin sold under the trademark of Amberlite IRA-401S, a product of the Rohm and Haas Company.

The anion exchange resin preferably has a moisture content between 45 and 80 percent, as previously defined. This level of moisture content indicates a high porosity which provides a desirable removal of chromophoric components by diffusion of the components into the resin matrix. In the most preferred embodiment, the cation exchange resin also has the same range of moisture content, particularly as the ratio of anion exchange resins to cation exchange resins approaches 1:1.

The filter aid material referred to above is preferably a fibrous substance, with each fiber having a diameter of less than 50 microns and a length of less than 1 millimeter. By the term "filter aid material" is meant those materials that are conventionally deposited on a filter screen or the like in order to aid the filtration which is produced by the filter. The filter aid material is typically one that is characterized by a negative surface charge in aqueous suspension. In the preferred embodiment, anion exchange resin is present in an amount greater than or equal to that of cation exchange resin, and therefore, a positively charged resin predominates. Negatively charged filter aid material has been found to flocculate well with the preferred resin mixture of the present invention. Suitable filter aid materials are well known in the art, and include cellulose fibers, diatomaceous earth, charcoal, expanded perlite, asbestos fibers, polyacrylonitrile fibers, and the like. A particularly preferred filter aid material for use in accordance with the present invention is alpha cellulose fiber, available commercially under the trade name Solka-Floc.

In preparing a filter material in accordance with the present invention to be precoated on the porous support means for the purification of sugar syrup, the preferred method is first to slurry the ion exchange resins, either cationic, anionic, or both, in a relatively large volume of demineralized water, such as ten gallons of water per pound of resin. The filter aid material is then added with continuous stirring to insure homogeneous mixing. It has been found that, when the treated filter aid material having a negative surface charge is mixed with anion exchange resin, a volume expansion of the suspension is produced, similar to the so-called "clumping" effect described in the aforementioned Levendusky patent, U.S. Pat. No. 3,250,703. After a sufficient period of stirring to insure complete mixing, such as five to twenty minutes, the cation exchange resin is added, and stirring is continued for a similar period to insure complete mixing of all three materials. The addition of the cation exchange resin ordinarily produces a reduction in the volume of the suspended material. Generally, however, the volume of the suspension will still be larger than that desired for precoating onto a filter bed, and the supernate may also contain cation exchange fines. The volume may be further reduced, and the supernate clarified, by the addition of a suitable water-soluble polyelectrolyte such as plyacrylic acid in a relatively small amount, e.g., 0.05 to 1% by dry weight of the resin particle mixture. Such a method of controlling the volume of mixed, suspended anion and cation exchange resins is well known in the art, and described in U.S. Pat. No. 3,250,704, which is issued to Levendusky and assigned to the assignee of the present invention.

Once the precoat material has been prepared in aqueous suspension, it is precoated on to a filter according to methods which are well known in the art, such as shown and described in U.S. Pat. No. 3,779,386, assigned to the assignee of this present invention. Simply stated, the precoat is formed by recirculating the suspension through the filter until a clarified effluent is obtained. The filter is then ready for use in the removal of impurities from liquids such as sugar syrups according to present invention by passing the sugar syrup through the precoat layer and porous precoat support means.

EXAMPLE

This example illustrates the comparative effect of using anion and cation exchange resins for purification of sugar syrups with and without filter aid material. Two Millipore filter membranes (5 microns pore diameter), each 47 millimeters in diameter, were coated with a slurried mixture. The first mixture on the first membrane included 0.94 grams of anion exchange resin (20 microns in diameter), and 0.94 grams of cation exchange resin (40 microns in diameter). The second membrane was covered with a composition of 0.94 grams of anion exchange resin (20 microns in diameter), 0.94 grams of cation exchange resin (40 microns in diameter), and 0.94 grams of alpha cellulose.

An affinated, defecated, and carbon-treated cane sugar syrup having an absorbence of 660 ICUMSA units was heated to 180° F. and passed through each precoated Millipore filter membrane at a flow rate of ⅛ gallon per minute per square foot and constantly monitored for color. The ICUMSA units were measured according to ICUMSA color method four (1970), reporting the attentuation index of a sugar solution multiplied by 1000. The data for the filter runs through each of the membranes is set forth below. As noted, the run through the membrane that was not coated with alpha cellulose was interrupted because of excessive pressure drop caused by fouling of the filter. Therefore, use of a filter aid material significantly increases run lengths and efficiency of purification of sugar syrup using relatively small particles of ion exchange resins.

TABLE I

Pressure Drop vs. Throughput (1:1 ratio of cation exchange resin to anion exchange resin)

| Throughput (Liters) | Pressure Drop (Inches Hg) |
|---|---|
| 0 | 8 |
| 0.5 | 13 |
| 1.0 | 18 |
| 1.5 | 22 |
| 2.0 | 27 |
| (Run terminated Due To Excessive Pressure Drop) | |

TABLE II

Pressure Drop v. Throughput (1:1:1 ratio of cation exchange resin to anion exchange resin to fibrous filter aid material)

| Throughput (Liters) | Pressure Drop (Inches Hg) |
|---|---|
| O | 5 |
| 0.5 | 5 |
| 1.0 | 7 |
| 1.5 | 7 |
| 2.0 | 8 |

The above example is intended to illustrate the present invention, and its advantages. This example should not be considered as limiting the present invention, the scope of which is determined by the appended claims. Furthermore, though the embodiments hereinbefore decribed are preferred, many other modifications and refinements which do not depart from the true spirit and scope of the present invention may be conceived by those skilled in the art. It is intended that all such modifications and refinements be covered by the following claims.

We claim:

1. A method for purification of a polyhydric alcohol comprising:

preparing a liquid slurry mixture of filter particles, including an anion exchange resin, a cation exchange resin, and a filter aid material, said anion exchange resin particles and said cation exchange resin particles being smaller than about 37 microns;

precoating a porous support means with said slurry mixture to form a precoat layer; and passing the polyhydric alcohol through said precoat layer and said porous support means to purify the polyhydric alcohol.

2. The method of claim 1 wherein the dry weight ratio of anion exchange resin to cation exchange resin is between 1:1 and 99:1, and the dry weight ratio of total ion exchange resin to the filter aid material is between 1:4 and 9:1.

3. The method of claim 1 wherein the anion exchange resin, cation exchange resin, and filter aid material are present in about equal amounts by dry weight.

4. The method of claim 1 wherein the filter aid material is a fibrous substance, each fiber having a diameter of less than 50 microns and a length of less than 1 millimeter.

5. The method of claim 1 wherein the polyhydric alcohol is passed through said precoat layer and said porous support means at a temperature between 120° F. and 180° F. and a flow rate between 0.1 and 2 gallons per minute per square foot.

6. The method of claim 1 further comprising the step of regenerating said filter particle mixture by delivering a brine solution through said mixture, while said mixture remains on said porous support means.

7. The method of claim 6 wherein the regenerating step includes adjusting pH of the brine solution to between 7 to 10.

8. The method of claim 1 wherein the anion exchange resin has a moisture content between 45 and 80 percent.

9. A method of purifying sugar syrup by removing chromophoric components, trace metals and other impurities, comprising:

preparing a mixture of filter particles in a size range of 10 to 30 microns in a liquid slurry, said filter particles including an anion exchange resin having a moisture content between 45 and 80 percent, a cation exchange resin, and a fibrous filter aid material;

precoating a tubular, porous filter element with a layer of said filter particles by delivering the slurry mixture to said filter element so that a precoat layer of 0.1 to 1.0 pounds per square foot of filter element area is formed; and passing sugar syrup through said precoat layer and said filter element at a temperature between 120° F. and 180° F., and a flow rate of 0.1 to 2 gallons per minute per square foot.

10. The method of claim 9 wherein the cation exchange resin has a moisture content between 45 and 80 percent.

11. The method of claim 1 or 9 wherein the anion exchange resins are quaternized, aminolyzed cross-linked acrylate esters in the chloride form, the cation exchange resins are sulfonated cross-linked styrene-divinylbenzene in the sodium form, and the fibrous filter aid material is alpha cellulose.

12. The method of claim 9 wherein the sugar syrup is passed through said precoat layer and said filter element at a temperature of about 180° F. and a flow rate of about $\frac{1}{8}$ gallon per minute per square foot.

* * * * *

UNITED STATES PATENT AND TRADEMARK OFFICE

CERTIFICATE OF CORRECTION

PATENT NO. : 4,187,120

DATED : February 5, 1980

INVENTOR(S) : Robert Kunin and Louis I. Blaine

It is certified that error appears in the above-identified patent and that said Letters Patent are hereby corrected as shown below:

Column 2, line 50, change "in" to --is--.

Column 3, line 52, change "allow" to --allows--.

Column 3, line 55, change "are" to --area--.

Column 6, line 10, change "to" to --and--.

Column 6, line 63, after "filter aid material" insert --it--.

Column 7, line 38, change "plyacrylic" to --polyacrylic--.

Column 7, line 54, after "to" insert --the--.

Column 8, line 11, change "attentuation" to --attenuation--.

UNITED STATES PATENT AND TRADEMARK OFFICE

CERTIFICATE OF CORRECTION

PATENT NO. : 4,187,120

DATED : February 5, 1980

INVENTOR(S) : Robert Kunin and Louis I. Blaine

It is certified that error appears in the above-identified patent and that said Letters Patent are hereby corrected as shown below:

Column 8, Table II, line 41, change "O" to --0--.

Column 9, line 29, after "adjusting" insert --the--.

Column 9, line 30, change "to" to --and--.

Signed and Sealed this

*Thirtieth* Day of *September 1980*

[SEAL]

*Attest:*

SIDNEY A. DIAMOND

*Attesting Officer*

*Commissioner of Patents and Trademark*